US008909098B2

(12) United States Patent
Itabashi

(10) Patent No.: US 8,909,098 B2
(45) Date of Patent: Dec. 9, 2014

(54) DEVELOPING DEVICE PROVIDED WITH DEVELOPING ROLLER AND SUPPLY ROLLER

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 114 days.

(21) Appl. No.: 13/599,281

(22) Filed: Aug. 30, 2012

(65) Prior Publication Data

US 2013/0051866 A1 Feb. 28, 2013

(30) Foreign Application Priority Data

Aug. 31, 2011 (JP) ..... 2011-190027

(51) Int. Cl.
*G03G 15/00* (2006.01)
*G03G 15/08* (2006.01)

(52) U.S. Cl.
CPC ..... *G03G 15/0896* (2013.01); *G03G 15/0808* (2013.01)
USPC ..... 399/117

(58) Field of Classification Search
USPC ..... 399/113, 117, 271
See application file for complete search history.

(56) References Cited

U.S. PATENT DOCUMENTS

| | | | |
|---|---|---|---|
| 6,349,189 | B1 | 2/2002 | Jeon |
| 6,356,723 | B1 | 3/2002 | Sato et al. |
| 6,496,669 | B2 | 12/2002 | Sato et al. |
| 2002/0090226 | A1 | 7/2002 | Sato et al. |
| 2011/0158710 | A1 | 6/2011 | Shiraki et al. |

FOREIGN PATENT DOCUMENTS

| | | | |
|---|---|---|---|
| CN | 1290871 | A | 4/2001 |
| CN | 1510533 | A | 7/2004 |
| CN | 2920663 | Y | 7/2007 |
| EP | 1079279 | A | 2/2001 |
| JP | 11-272049 | A | 10/1999 |
| JP | 2003-043808 | A | 2/2003 |
| JP | 2007-051744 | A | 3/2007 |
| JP | 2011-133755 | A | 7/2011 |

OTHER PUBLICATIONS

First Office Action issued in corresponding Chinese Patent Application No. 201210324588.7 dated May 5, 2014.

*Primary Examiner* — Walter L Lindsay, Jr.
*Assistant Examiner* — Barnabas Fekete
(74) *Attorney, Agent, or Firm* — Banner & Witcoff, Ltd.

(57) ABSTRACT

In a developing device, a developing roller has: a first rotational shaft extending in a first direction; and a first roller body covering the first rotational shaft and configured to carry developer. A supply roller has: a second rotational shaft extending in the first direction; and a second roller body covering the second rotational shaft and configured to supply the developer to the developing roller. A housing accommodates the developing roller, the supply roller, and the developer. The housing includes a first wall and a second wall opposed with each other in the first direction. The first wall is formed with a first cutout. The second wall being formed with a second cutout. The first rotational shaft and the second rotational shaft are positioned in both the first cutout and the second cutout when projected in the first direction.

13 Claims, 10 Drawing Sheets

DEVELOPING DEVICE PROVIDED WITH DEVELOPING ROLLER AND SUPPLY ROLLER

CROSS REFERENCE TO RELATED APPLICATION

This application claims priority from Japanese Patent Application No. 2011-190027 filed Aug. 31, 2011. The entire content of this application is incorporated herein by reference.

TECHNICAL FIELD

The present invention relates to a developing device that is detachably mountable in an image-forming device.

BACKGROUND

An electrophotographic printer known in the art has developing devices detachably mounted therein. Each developing device includes a developing frame, a developing roller and a supply roller that are supported in the developing frame.

One such developing device that has been proposed is a developer cartridge that includes a cartridge frame, a developing roller rotatably supported in the cartridge frame, and a supply roller rotatably supported in the cartridge frame while confronting and contacting the developing roller. Receiving grooves extending in the general front-rear direction are formed in both left and right side walls of the cartridge frame for receiving ends of rotational shafts provided in the developing roller and supply roller, and a rib vertically intersecting the groove in the right side wall through the approximate front-rear center thereof so as to bridge the top and bottom of the groove.

SUMMARY

However, the rib bridges the receiving groove in the right side wall of this developer cartridge. Thus, when mounting the supply roller in the cartridge frame, it is necessary to hold the supply roller at an angle while inserting the right end of the supply roller into a portion of the groove in the right side wall that is positioned rearward of the rib and to subsequently insert the left end of the supply roller through the front side of the groove formed in the left side wall. Accordingly, this construction complicates the operation for mounting the supply roller in the cartridge frame.

Therefore, it is an object of the present invention to provide a developing device capable of streamlining the operation for mounting the supply roller in the developing-device casing. It is another object of the present invention to provide a method of manufacturing such a developing device.

In order to attain the above and other objects, the invention provides a developing device. The developing device includes a developing roller, a supply roller, and a housing. The developing roller has: a first rotational shaft extending in a first direction; and a first roller body covering the first rotational shaft and configured to carry developer. The supply roller has: a second rotational shaft extending in the first direction; and a second roller body covering the second rotational shaft and configured to supply the developer to the developing roller. The housing accommodates the developing roller, the supply roller, and the developer. The housing includes a first wall and a second wall opposed with each other in the first direction. The first wall is formed with a first cutout. The second wall is formed with a second cutout. The first rotational shaft and the second rotational shaft are positioned in both the first cutout and the second cutout when projected in the first direction.

According to another aspect, the present invention provides a method for assembling a developing device. The method includes: preparing a developing roller having: a first rotational shaft extending in a first direction; and a first roller body covering the first rotational shaft and configured to carry developer; preparing a supply roller having: a second rotational shaft extending in the first direction; and a second roller body covering the second rotational shaft and configured to supply the developer to the developing roller; and preparing a housing comprising: a first wall, and a second wall opposed with each other in the first direction, where the first wall is formed with a first cutout, the second wall is formed with a second cutout, the housing is formed with an opening, the first cutout and the of the second cutout configures a part of the opening; assembling, to the housing, the supply roller with one end of the second rotational shaft being moved in the first cutout and another end of the second rotational shaft being moved in the second cutout; and assembling, to the housing, the developing roller with one end of the first rotational shaft being moved in the first cutout and another end of the second rotational shaft being moved in the second cutout until the developing roller contacts the supply roller.

BRIEF DESCRIPTION OF THE DRAWINGS

The particular features and advantages of the invention as well as other objects will become apparent from the following description taken in connection with the accompanying drawings, in which:

FIG. 9(*b*) is a plan view of a developing roller according to the second embodiment;

FIG. 9(*c*) is an enlarged view showing a right end of the lower frame when the developing roller shown in FIG. 9(*b*) is mounted in the lower frame shown in FIG. 9(*a*);

FIG. 10(*b*) is a plan view showing a developing roller cartridge according to fourth embodiment; and FIG. 10(*c*) is a plan view showing a developing roller cartridge according to a fifth embodiment.

DETAILED DESCRIPTION

1. Printer

Figure 1:
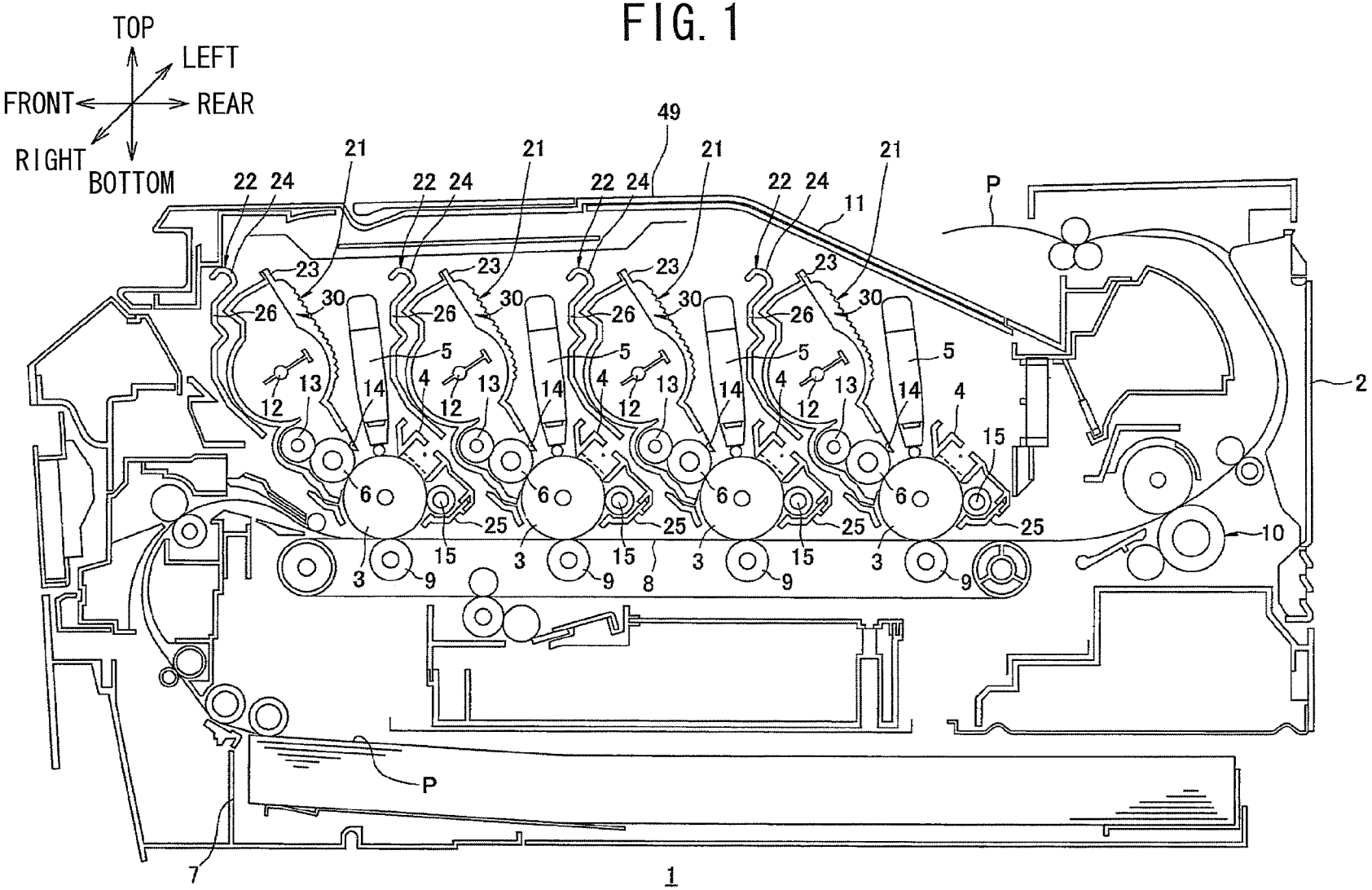
FIG. 1 is a lateral cross-sectional view of a printer according to a first embodiment of the present invention.

As shown in FIG. 1, a printer 1 is a direct tandem-type color printer.

In the following description, directions with respect to the printer 1 and developer cartridges 23 (described later) will correspond to the directions of the arrows indicated in the drawings and will assume that the printer 1 and the developer cartridges 23 are in a level orientation. In addition, the left-right direction will be equivalent to the width direction.

Specifically, the vertical and front-rear directions of the printer 1 differ from the vertical and front-rear directions of the developer cartridges 23. The developer cartridges 23 are mounted in the printer 1 and drum cartridges 22 so that their front side faces the upper front side of the printer 1 and their rear side faces the bottom rear side of the printer 1.

The printer 1 includes a main casing 2. Four photosensitive drums 3 are arranged inside the main casing 2 parallel to each other and juxtaposed in the front-rear direction. The four photosensitive drums 3 are differentiated according to the colors (black, yellow, magenta, and cyan) of toner images.

Disposed in opposition to each photosensitive drum 3 are a Scorotron charger 4, an LED unit 5, and a developing roller 6.

The surfaces of the photosensitive drums 3 are uniformly charged by the corresponding Scorotron chargers 4 and are subsequently exposed to light emitted by the corresponding LED units 5 based on image data, forming electrostatic latent images on the surfaces of the respective photosensitive drums 3. Toner carried on the developing rollers 6 is supplied to the corresponding latent images, producing visible toner images on the surfaces of the photosensitive drums 3.

Sheets P of a paper are accommodated in a paper cassette 7 inside the main casing 2. Various rollers are provided for supplying the sheets P from the paper cassette 7 to a conveying belt 8.

The conveying belt 8 is disposed between the photosensitive drums 3, and transfer rollers 9 disposed at positions confronting the respective photosensitive drums 3. A transfer bias is applied to the transfer roller 9 for sequentially transferring the toner images carried on the photosensitive drums 3 onto the sheet P so that the images are superimposed.

After toner images in the four colors have been transferred onto the sheet P, the sheet P is conveyed to a fixing unit 10. The fixing unit 10 fixes the toner images to the sheet P with heat. Various rollers are provided for subsequently discharging the sheet P into a discharge tray 11.

2. Process Cartridges

The printer 1 is provided with four process cartridges 21 corresponding to the four printing colors.

The process cartridges 21 are detachably mounted in the main casing 2 and are arranged parallel to one another and juxtaposed in the front-rear direction.

A top cover 49 is provided in the top wall of the main casing 2 and can be opened and closed. The process cartridges 21 can be mounted in or removed from the main casing 2 by opening the top cover 49.

Each process cartridge 21 includes a drum cartridge 22 detachably mounted in the main casing 2, and a developer cartridge 23 detachably mounted in the drum cartridge 22.

(1) Drum Cartridges

The drum cartridge 22 is configured of a drum frame 24. The drum frame 24 further includes a drum support part 25, and a developer-cartridge-accommodating part 26.

The drum support part 25 constitutes the lower rear side of the drum frame 24 and functions to support the corresponding photosensitive drum 3, the Scorotron charger 4, and a drum cleaning roller 15.

The photosensitive drums 3 are substantially cylindrical in shape and elongated in the left-right direction. The photosensitive drums 3 are rotatably supported in bottom ends of the respective drum support parts 25 and exposed through openings formed in the bottoms of the same. The Scorotron chargers 4 are disposed so as to confront the corresponding photosensitive drums 3 from a position diagonally above and rearward therefrom, but are separated from the same. The drum cleaning rollers 15 are disposed on the rear side of their corresponding photosensitive drums 3, confronting and contacting the same.

The developer-cartridge-accommodating part 26 of each drum frame 24 is provided above and forward from the drum support part 25 and is formed with an opening on the top and rear sides to allow mounting and removal of the corresponding developer cartridge 23.

(2) Developer Cartridges

Figure 2:
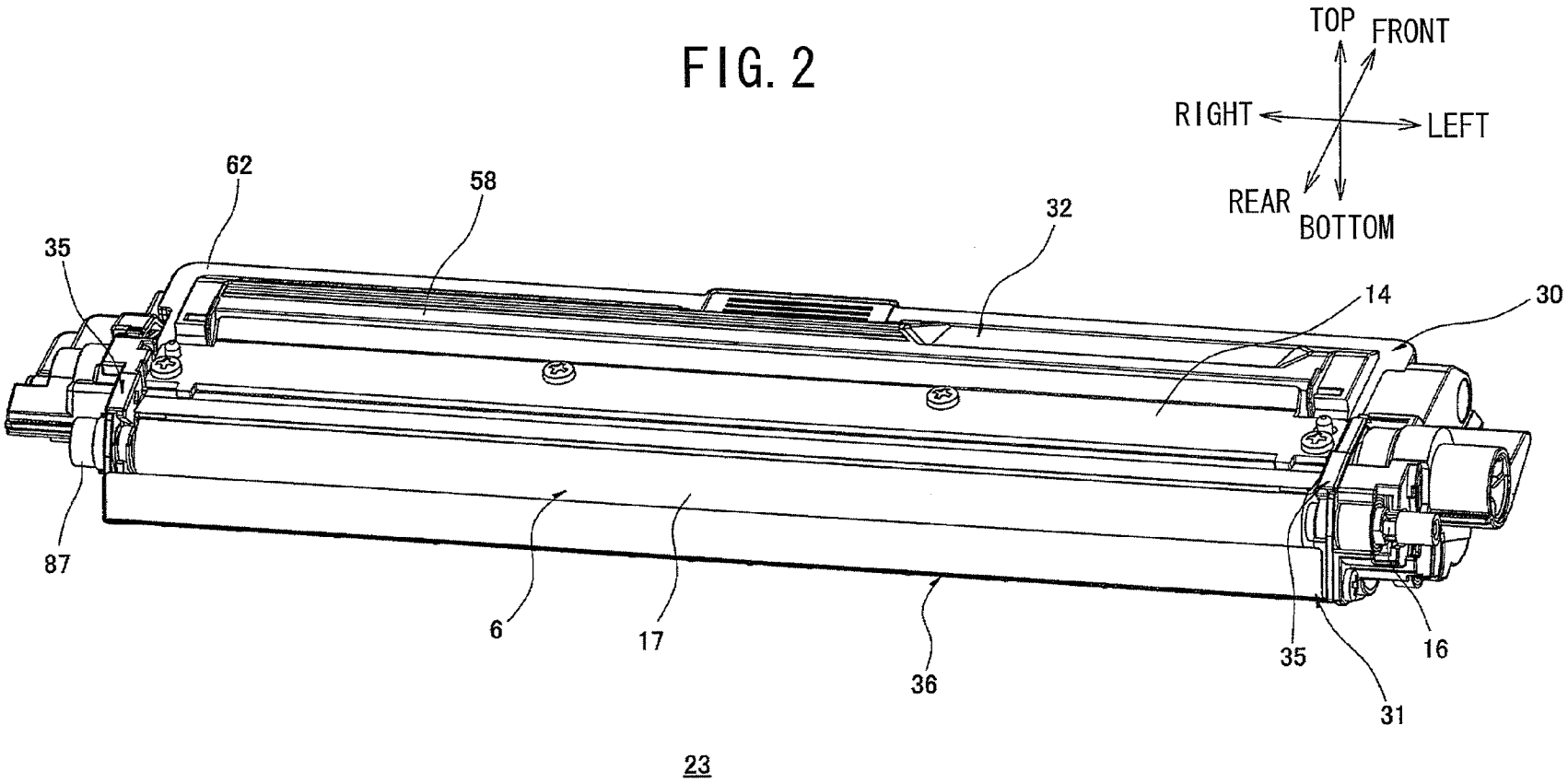
FIG. 2 is a perspective view of a developer cartridge according to the first embodiment of the present invention when viewed from a left-top side.
Figure 3:
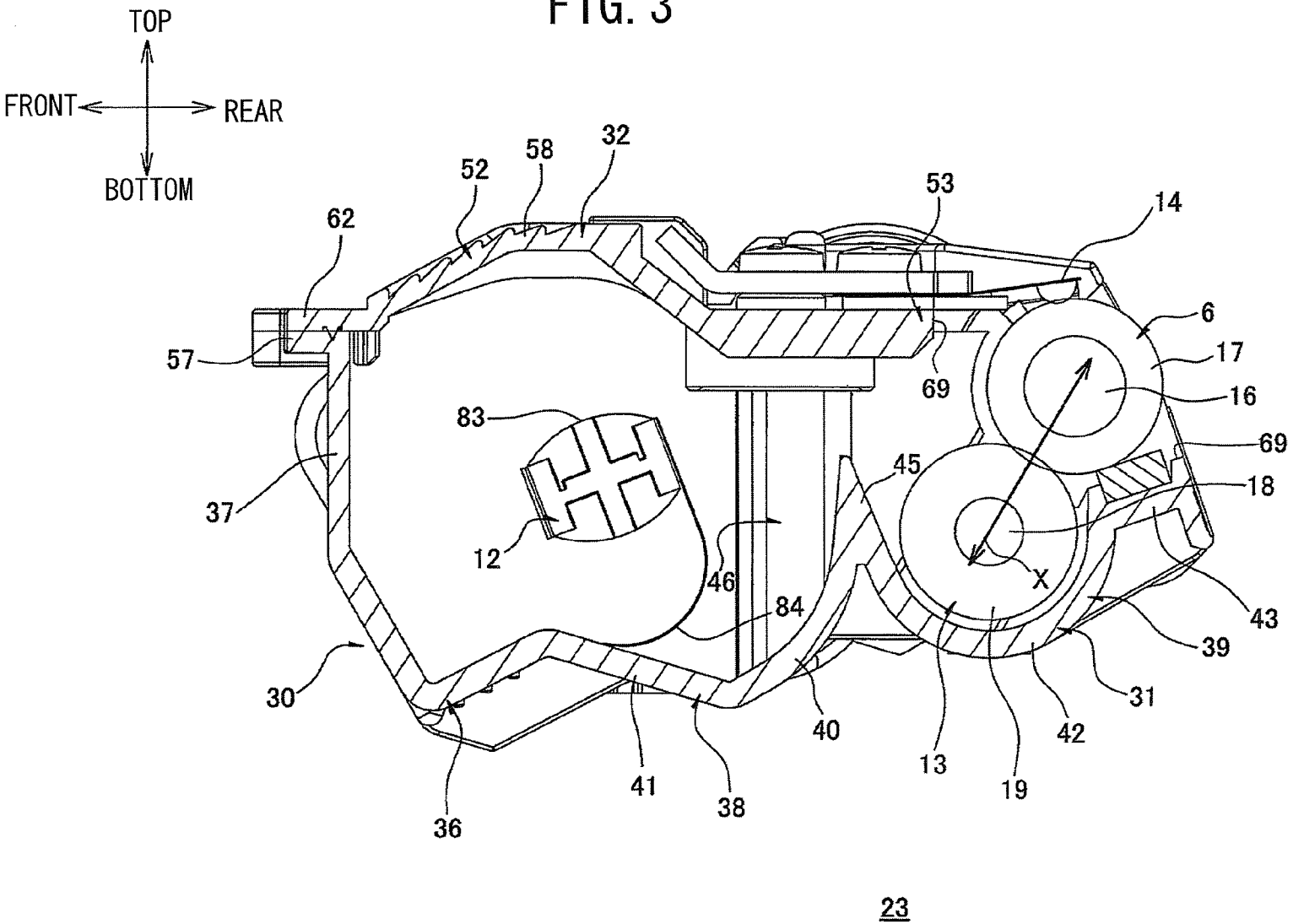
FIG. 3 is a lateral cross-sectional view of the developer cartridge shown in FIG. 2.

As shown in FIGS. 2 and 3, each of the developer cartridges 23 is configured of a developer frame 30. The developer frame 30 is a housing and generally box-shaped and elongated in the left-right direction. The developer frame 30 includes a lower frame 31, and an upper frame 32 assembled on the lower frame 31.

(2-1) Lower Frame

Figure 6:
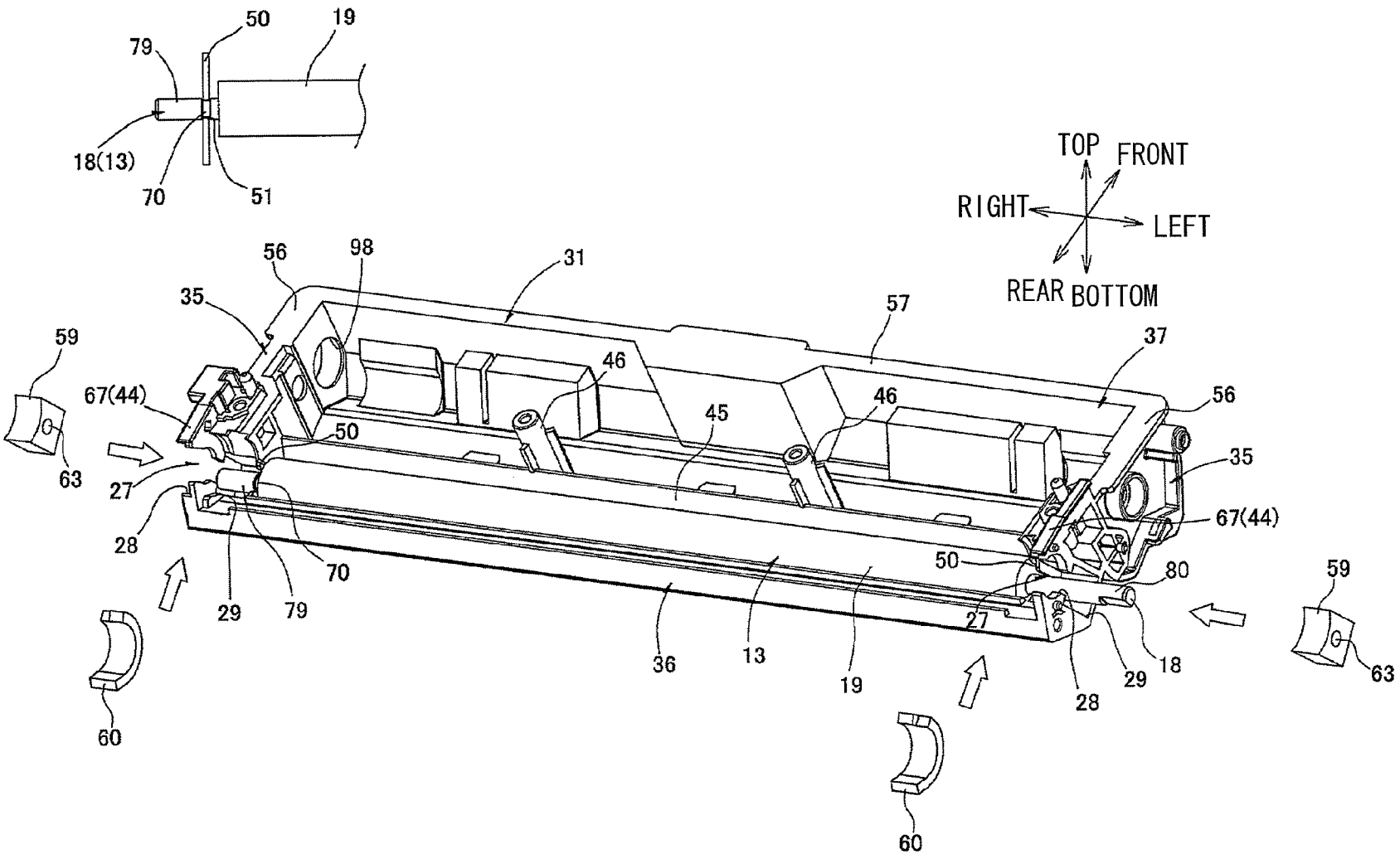
FIG. 6 is an explanation diagram illustrating assembling a supply roller in the lower frame and first and second sealing members.

As shown in FIG. 6, the lower frame 31 is integrally configured of a pair of side walls 35 arranged parallel to each other and separated in the width direction; a bottom wall 36 connecting the bottom edges of the pair of side walls 35; and a front wall 37 connecting the front edges of the pair of side walls 35 and the bottom wall 36.

Each side wall 35 has a generally flat plate shape. First contact parts 56 are formed on the front portion of each side wall 35, and first openings 27 and flange parts 44 are formed in the rear portion of each side wall 35.

Each of the first contact parts 56 has a generally flat plate shape. The first contact parts 56 are respectively provided on the top edges of the left and right side walls 35 and extend continuously outward from the top edges in corresponding left and right directions.

Figure 4:
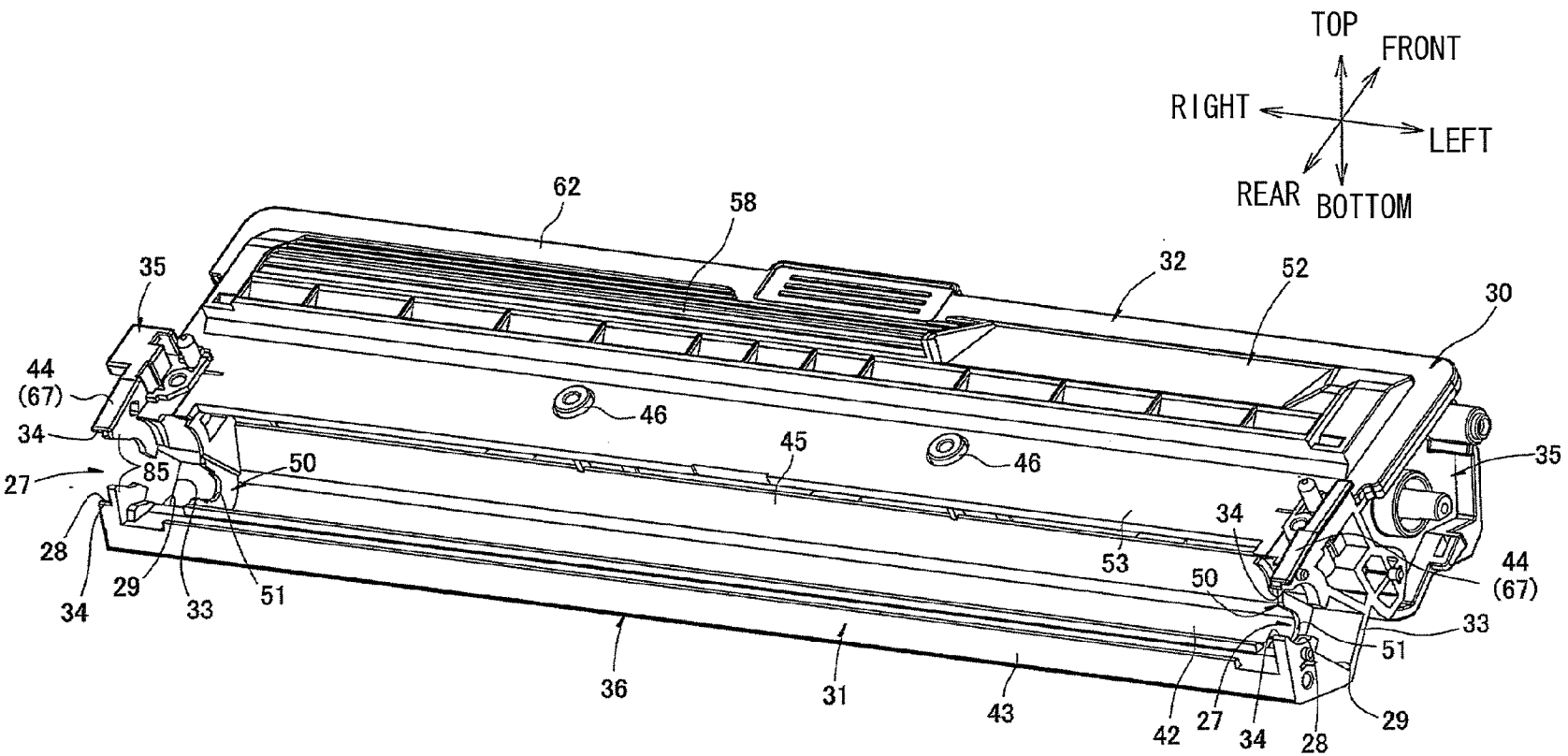
FIG. 4 is a perspective view of a lower frame when vied from a left-top side.
Figure 8:
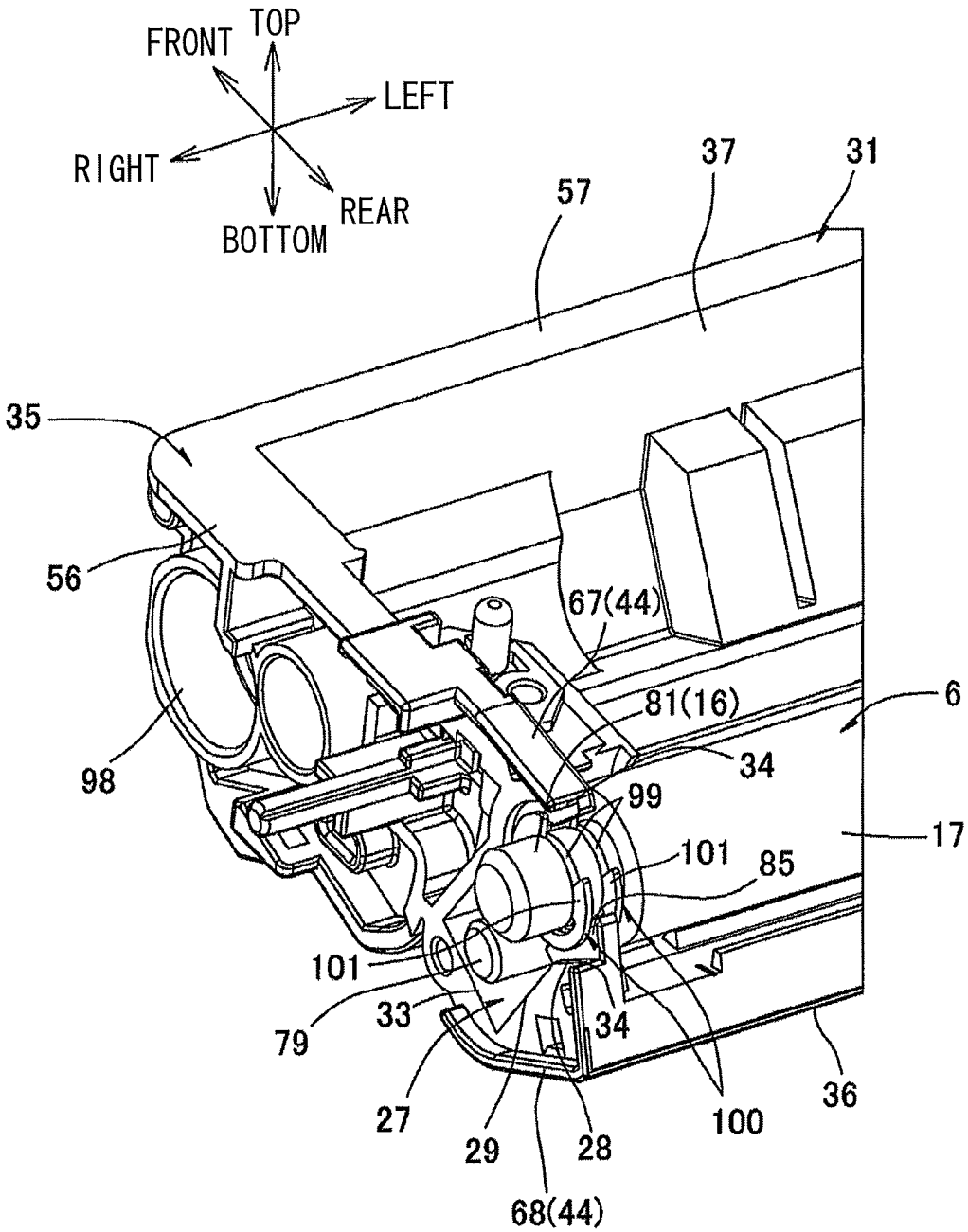
FIG. 8 is an enlarged view of a left side of the lower frame when the developing roller is assembled in the lower frame.

As shown in FIGS. 4 and 8, the flange part 44 includes upper flange parts 67 provided on the top edges of the left and right side walls 35 and a lower flange part 68 provided on the bottom edge and the rear edge of the right side wall 35.

Each upper flange part 67 has a generally flat plate shape. The upper flange parts 67 extend continuously outward from the top edges of the side walls in corresponding left and right directions.

As shown in FIG. 8, the lower flange part 68 is L-shaped form in a side view continuously protruding outward from the bottom end and rear end of the right side wall 35.

Figure 5:
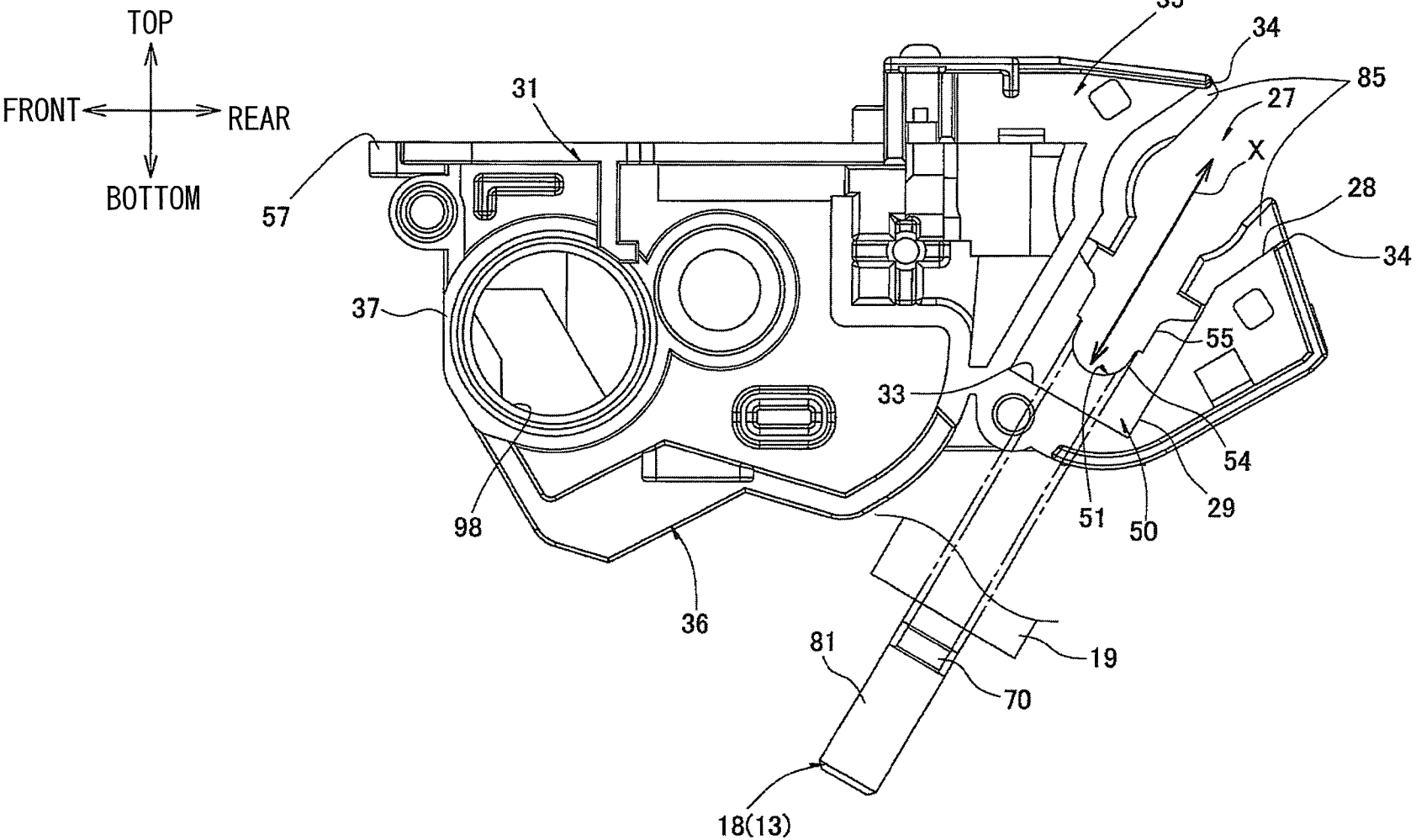
FIG. 5 is a right side view of the lower frame shown in FIG. 4.

As shown in FIG. 4, the first openings 27 extend in a direction X (see FIG. 5) from each of left and right ends of the developing cartridge 23. Specifically, the first openings 27 are formed at mutually opposing positions in the left and right side walls 35, respectively. As shown in FIG. 5, the first openings 27 are recesses formed in the upper rear edges of the corresponding left and right side walls 35 that penetrate toward the bottom front sides of the same along the direction X orthogonal to the left-right direction. The direction X corresponds to the direction in which a rubber roller 17 and sponge roller 19 (described later) oppose each other (see FIG. 3).

Each opening 27 includes a developing-roller-shaft-exposing groove 28 occupying the upper portion thereof, and a supply-roller-shaft-exposing groove 29 occupying the lower portion thereof.

As shown in FIG. 5, each exposing groove 29 is generally rectangular in a side view. A closed edge 33 is formed at the lower end of each exposing groove 29. The sides of the exposing grooves 29 are formed longer than the diameter of an exposed part 80 of a supply roller shaft 18 (described later).

Each exposing groove 28 is continuously formed from upper end of the exposing hole 29. Open edges 34 are provided at the rear end of each exposing groove 28. That is, the closed edge 33 and the open edges 34 are provided as ends of the opening 27 in the direction X.

Figure 7:
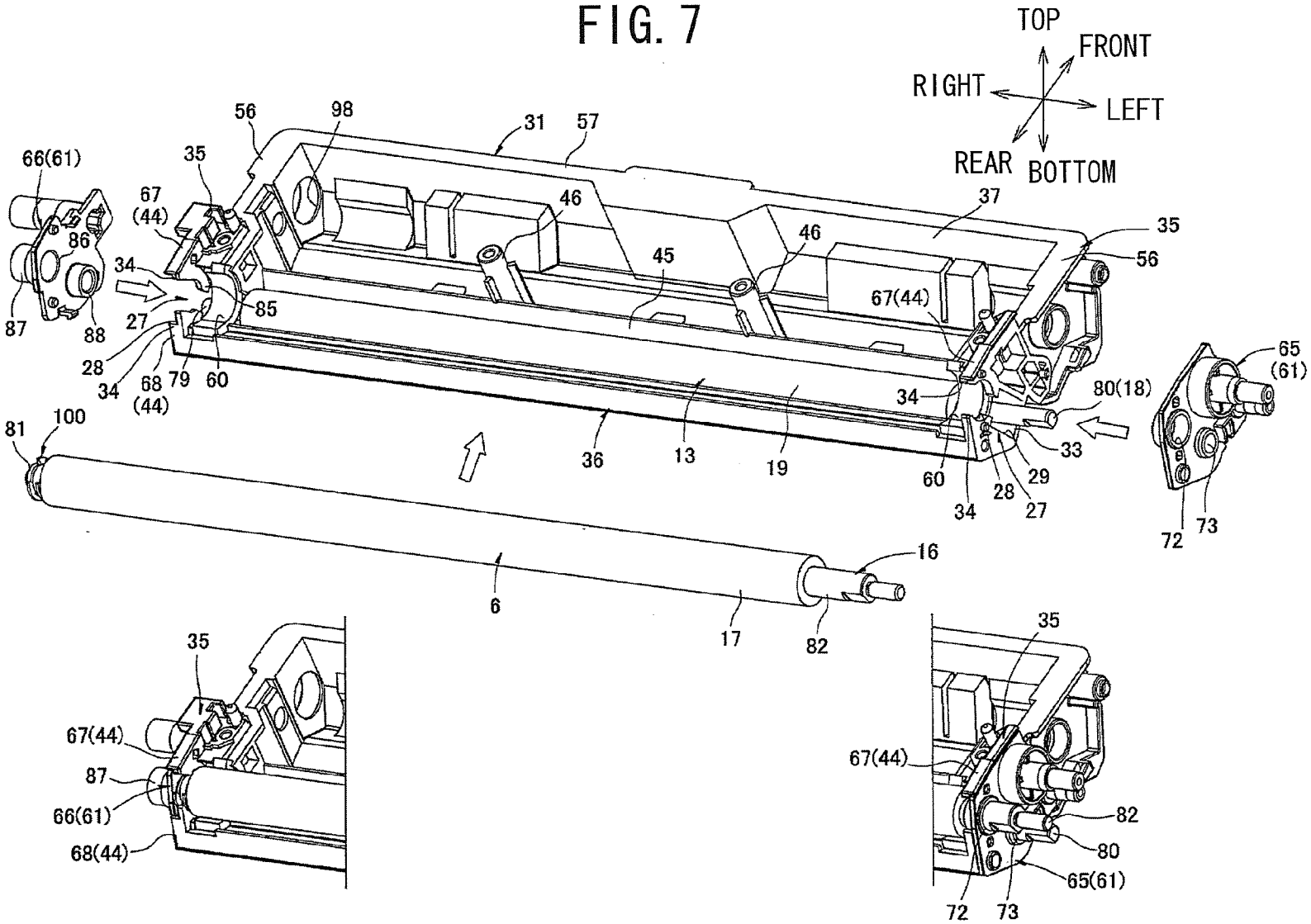
FIG. 7 is an explanatory diagram illustrating assembling a developing roller and bearing members in the lower frame.

More specifically, as shown in FIG. 4, the exposing groove 28 formed in the left side wall 35 (the left exposing groove 28) has a substantial circular shape whose lower end is cut to be in communication with the exposing groove 29 (that is, the exposing groove 28 is continuously formed from the exposing groove 29). The substantial circular shape of the exposing groove 28 fits the outer surface of a left developing-roller-shaft exposed part 82 (described later). Further, as shown in FIG. 7, the diameter of the left exposing groove 28 (the length of the left exposing groove 28 in a length direction orthogonal to the direction X and the left-right direction) is formed larger than the diameter of left developing-roller-shaft exposed part 82 (described later).

As shown in FIG. 5, the exposing groove 28 formed in the right side wall 35 (the right exposing groove 28) is formed of a lower rear edge that extends diagonally upward and rearward from the top end of a front edge defining the exposing groove 29, and an upper front edge depressed diagonally upward and forward. Further, the width of the right exposing groove 28 (the length of the right exposing groove 28 in the length direction) is formed larger than the outer diameter of contact members 100 (described later).

Retaining parts 85 are also formed in the right exposing groove 28. The retaining parts 85 have a generally flat plate shape and protrude inward in front and rear directions from left portions of the lower rear edge and upper front edge constituting the right exposing groove 28 (see FIG. 4). Center portions of the retaining parts 85 relative to the second direction X are formed in a general arc shape that conforms to the outer peripheral surface of a right developing-roller-shaft exposed part 81 (described later). Specifically, the center portion of the front retaining part 85 relative to the second direction X is recessed in a direction obliquely upward and forward, while the center portion of the rear retaining part 85 relative to the second direction X is recessed in a direction obliquely downward and rearward.

As shown in FIG. 8, a toner fill hole 98 is formed in the right side wall 35. The toner fill hole 98 is generally circular in a side view and is formed in a front-side portion of the right side wall 35.

As shown in FIG. 3, the front portion of the bottom wall 36 is formed continuously of a curved wall 40, and a bent wall 41, while the rear portion of the bottom wall 36 is formed continuously of an arc-shaped wall 42, and a rib part 43.

The curved wall 40 has a general arc shape that follows the rotational path of an agitator 12 (described later).

The bent wall 41 has an upward bend formed at a midpoint in the front-rear direction. More specifically, beginning from its rear edge, the bent wall 41 slopes upward toward the front from the front edge of the curved wall 40 and subsequently bends so as to slope downward toward the front.

The arc-shaped wall 42 has a general arc shape that follows the rotational path of a supply roller 13 (described later).

The rib part 43 has a general T-shape in a side view, with the bottom of the "T" formed continuously with the rear edge of the arc-shaped wall 42 and the head of the "T" protruding rearward.

The front portion and the rear portion of the bottom wall 36 are formed continuously by coupling the rear edge of the curved wall 40 with the front edge of the arc-shaped wall 42.

A partitioning wall 45 is formed between the front portion and the rear portion of the bottom wall 36. The partitioning wall 45 is formed as a continuous extension from the curved wall 40 and the arc-shaped wall 42, protruding upward. That is, the partitioning wall 45 protrudes toward the upper frame 32 while extending in the left-right direction.

The distal end of the partitioning wall 45 vertically confronts but is separated from the bottom surface of a rear-side top wall 53 (described later) of the upper frame 32.

As shown in FIGS. 4 and 6, a plurality (two in the embodiment) of fixing parts 46 is formed in the bottom wall 36 adjacent to the front side of the partitioning wall 45.

The fixing parts 46 are disposed at the front side of the partitioning wall 45. The fixing parts 46 are adjacent and the partitioning wall 45. The fixing parts 46 are arranged in the left-right direction and separated each other. Each fixing part 46 is generally cylindrical in shape and is erected upward from the curved wall 40 (see FIG. 3). The distal ends of the first fixing parts 46 protrude upward from the rear-side top wall 53 (described later).

As shown in FIG. 4, the receiving parts 50 are disposed at positions spaced inward in right and left directions from the corresponding side walls 35 for receiving right and left supply-roller-shaft exposed parts 79 and 80 (described later). The receiving parts 50 have a generally flat plate shape and protrude diagonally upward and rearward from the arc-shaped wall 42. When projected in the left-right direction, the receiving parts 50 overlap the closed edges 33 of the exposing holes 29 (see FIG. 5).

A receiving groove 51 is formed in each receiving part 50 for receiving the supply roller shaft 18 (described later). The receiving grooves 51 are generally U-shaped in a side view and are recessed into the receiving parts 50 in the direction X so as to be open on the upper rear side (see FIG. 4). As shown in FIG. 5, the receiving groove 51 formed in the right receiving part 50 has a lower portion defined as a narrow groove 54, and an upper portion defined as a wide groove 55.

The narrow groove 54 is generally U-shaped in a side view. The width (the length in the length direction) of the narrow groove 54 is narrower than the width (the length in the length direction) of the left receiving groove 51 and wider than the diameter of a small-diameter part 70 formed on the supply roller shaft 18 (described later).

The wide groove 55 is formed continuously with the two ends of the narrow groove 54 (the ends at the open side of the narrow groove 54). After initially curving outward in the width direction, the wide groove 55 extends along the direction X. The width (the length in the length direction) of the wide groove 55 is greater than that of the narrow groove 54 and approximately equivalent to that of the receiving groove 51. The width (the length in the direction orthogonal to the direction X and the left-right direction) of the wide groove 55 is also substantially equivalent to the outer diameter of the supply roller shaft 18 (described later).

As shown in FIG. 3, the bottom portion of the front wall 37 is formed continuously from the front edge of the bent wall 41, sloping upward toward the front, while the upper portion of the front wall 37 extends straight upward continuously from the top edge of the lower portion.

A second contact part 57 is formed on the top edge of the front wall 37. As shown in FIG. 6, the second contact part 57 has a generally flat plate shape that extends continuously forward from the top edge of the front wall 37.

(2-2) Upper Frame

As shown in FIG. 3, the upper frame 32 is integrally provided with a front-side top wall 52, and a rear-side top wall 53. The front-side top wall 52 is configured of an expanded part 58, and a contact part 62. The expanded part 58 constitutes the central portion of the front-side top wall 52 and expands upward.

The contact part 62 has a substantially flat plate shape and is provided along both left and right sides and the front side of the expanded part 58 so as to surround the same. When the upper frame 32 is assembled to the lower frame 31, the contact part 62 conforms to the shape of the first and second contact parts 56 and 57.

As shown in FIG. 3, the rear-side top wall 53 has a generally flat plate shape and extends continuously rearward from the rear edge of the front-side top wall 52.

(2-3) Developer Frame

As shown in FIG. 3, when the lower frame 31 and the upper frame 32 are assembled together, as will be described later, a space formed in the developer frame 30 is divided by the partitioning wall 45 into the toner-accommodating chamber 38 constituting the space forward of the partitioning wall 45, and a developing chamber 39 constituting the space rearward of the partitioning wall 45. In other words, the partitioning wall 45 partitions the developer frame 30 into the toner-accommodating chamber 38 and the developing chamber 39.

(2-4) Toner-Accommodating Chamber

As shown in FIG. 3, the toner-accommodating chamber 38 is filled with toner. An agitator 12 is also provided in the toner-accommodating chamber 38 and positioned in the vertical and front-to-rear center thereof.

The agitator 12 includes a rotational shaft 83 that is rotatably supported in the side walls 35, and an agitating blade 84 provided on the rotational shaft 83. The agitating blade 84 is fixed to the outer peripheral surface of the rotational shaft 83 and extends radially outward therefrom. By supporting the rotational shaft 83 in the side walls 35, the agitator 12 is rotatably supported in the developer frame 30.

(2-5) Developing Chamber

As shown in FIG. 3, an opening 69 is formed in the rear side of the developing chamber 39. The opening 69 is specifically defined by the rear edges of the side walls 35, the rear edge of the rib part 43, and the rear edge of the rear-side top wall 53.

The developing roller 6, a supply roller 13, and a thickness-regulating blade 14 are provided inside the developing chamber 39. The developing roller 6 is disposed in the rear end of the developing chamber 39 between the side walls 35 so that the rear and top portions of the developing roller 6 are exposed through the opening 69.

The developing roller 6 is configured of a developing roller shaft 16, and a rubber roller 17 provided around the developing roller shaft 16. The rubber roller 17 covers the developing roller shaft 16 while leaving the left and right ends exposed. The outer peripheral surface of the rubber roller 17 carries the developer. By rotatably supporting the developing roller shaft 16 in the side walls 35, the developing roller 6 is rotatably disposed in the developer frame 30.

The developing roller 6 is oriented such that the developing roller shaft 16 extends in the left-right direction. The left end of the developing roller shaft 16 protruding out from the rubber roller 17 is defined as a left developing-roller-shaft exposed part 82, while the right end protruding from the rubber roller 17 is defined as a right developing-roller-shaft exposed part 81. The right developing-roller-shaft exposed part 81 has a shorter left-right dimension than the left developing-roller-shaft exposed part 82.

As shown in FIG. 8, engaging grooves 99 are formed in the right exposed part 81. Specifically, a pair of the engaging grooves 99 is formed in the right exposed part 81 of the developing roller shaft 16 at positions on either side of a portion of the right exposed part 81 aligned with the retaining parts 85. The engaging grooves 99 are recessed radially into the outer peripheral surface of the developing roller shaft 16.

The contact member 100 is provided for each of the engaging grooves 99. In other words, a pair of the contact members 100 is provided on the supply roller shaft 18 at a position corresponding to the engaging grooves 99 with respect to the left-right direction. The contact members 100 have a generally flat plate shape. In a side view, the contact members 100 are generally C-shaped, with the opening of the C shape facing upward. The free ends of the contact members 100 are configured as hook-like parts 101. The hook-like parts 101 are bent inward along a radial direction of the developing roller shaft 16 to form hook-like shapes in a side view. By engaging the hook-like parts 101 in the engaging grooves 99, the contact members 100 are positioned parallel to each other while separated in the left-right direction.

As will be described later in greater detail, by rotatably supporting the developing roller shaft 16 in the side walls 35, the developing roller 6 is rotatably disposed in the developer frame 30.

As shown in FIG. 3, the supply roller 13 is disposed inside the arc-shaped wall 42 on the lower front side of the developing roller 6. As shown in FIG. 6, the supply roller 13 includes a supply roller shaft 18, and a sponge roller 19.

The outer peripheral surface of the sponge roller 19 supplies toner to the surface of rubber roller 17. The sponge roller 19 covers the supply roller shaft 18 while leaving the left and right ends exposed.

The supply roller 13 is oriented so that the supply roller shaft 18 extends in the left-right direction. The left end of the supply roller shaft 18 protruding out of the sponge roller 19 is defined as a left supply-roller-shaft exposed part 80, while the right end of the supply roller shaft 18 protruding out of the sponge roller 19 is defined as a right supply-roller-shaft exposed part 79. The right supply-roller-shaft exposed part 79 is formed with a shorter left-right dimension than the left supply-roller-shaft exposed part 80.

A small-diameter part 70 is formed in the right exposed part 79. The small-diameter part 70 is formed in the right exposed part 79 at a position corresponding to the narrow groove 54 formed in the right receiving part 50 and is formed by recessing the outer peripheral surface of the supply roller shaft 18 radially inward so that the diameter of the small-diameter part 70 is smaller than the diameter of the left exposed part 80.

The supply roller 13 is positioned so that the sponge roller 19 of the supply roller 13 confronts and contacts the rubber roller 17 of the developing roller 6. As will be described later in greater detail, by rotatably supporting the left and right ends of the supply roller shaft 18 in the walls 35, the supply roller 13 is rotatably provided in the developer frame 30.

As shown in FIG. 3, the thickness-regulating blade 14 is fixed to the distal ends of the fixing parts 46 so that the rear end portion of the thickness-regulating blade 14 contacts the top of the rubber roller 17.

As shown in FIGS. 6 and 7, two each of first side sealing members 59, second side sealing members 60, and bearing members 61 are provided in the developing chamber 39.

The first side sealing members 59 are disposed in positions corresponding to the exposing holes 29. The first side sealing members 59 are generally rectangular in a side view. A through-hole 63 penetrates the center portion of each first side sealing member 59 in the left-right direction to allow passage of the supply roller shaft 18. As will be described later in greater detail, the left and right ends of the supply roller shaft 18 are inserted through the corresponding first side sealing members 59, with one of the first side sealing members 59 positioned between the left receiving part 50 and the left side wall 35 and the other between the right receiving part 50 and the right side wall 35.

The second side sealing members 60 are generally U-shaped in a side view, following the curved shape on the lower side of the exposing grooves 28. As will be described later in greater detail, the second side sealing members 60 are disposed above the corresponding first side sealing members 59, with one second side sealing member 60 interposed between each of the left and right ends of the supply roller shaft 18 and corresponding one of the left and right ends of the rubber roller 17.

As shown in FIG. 7, the bearing members 61 are formed of a resin material having good tribological properties (such as an electrically conductive polyacetal resin) in a flat plate shape that is substantially rectangular in a side view. That is, the bearing members 61 are formed separately from the developer frame 30.

The two bearing members 61 are further distinguished as a left bearing member 65 corresponding to the left side wall 35, and a right bearing member 66 corresponding to the right side wall 35.

The right bearing member 66 has a developing-roller-shaft-supporting hole 86, a developing-roller-shaft collar 87, and a supply-roller-shaft-supporting part 88.

The supporting hole 86 is generally circular in a side view and penetrates the upper rear portion of the right bearing member 66. The supporting hole 86 is formed with substantially the same (slightly larger) diameter as the outer diameter of the right exposed part 81.

The collar 87 has a generally cylindrical shape and protrudes rightward from the peripheral edge of the supporting hole 76.

The supporting part 88 is formed on the left surface of the right bearing member 66 at a position below and forward of the supporting hole 86. The supporting part 88 is generally cylindrical in shape and protrudes leftward from the left surface of the right bearing member 66. The supporting part 88 is formed with substantially the same (slightly larger) inner diameter as the outer diameter of the right exposed part 79.

The left bearing member 65 has a developing-roller-shaft-supporting hole 72 and a supply-roller-shaft-supporting hole 73. The supporting hole 72 is generally circular in a side view and penetrates the upper rear portion of the left bearing member 65. The supporting hole 72 is formed with substantially the same (slightly larger) diameter as the outer diameter of the left exposed part 82.

The supporting hole 73 is generally circular in a side view and penetrates a portion of the left bearing member at a front lower side of the supporting hole 73. The supporting hole 73 is formed with substantially the same (slightly larger) diameter as the outer diameter of the left exposed part 80.

As will be described later in greater detail, the left bearing member 65 is fitted into the left side wall 35 from the outer side thereof, while the right bearing member 66 is fitted into the right side wall 35 from the outer side thereof.

3. Assembling the Developer Cartridge

Next, the process for assembling the developer cartridge 23 will be described.

(1) Assembling the Supply Roller in the Lower Frame

To assemble the developer cartridge 23, first the supply roller 13 and the lower frame 31 are prepared as described above, and the supply roller 13 is assembled in the lower frame 31, as shown in FIG. 6.

To assemble the supply roller 13 in the lower frame 31, the supply roller 13 is positioned on the upper rear side of the lower frame 31 so that the left exposed part 80 is positioned above and rearward of the left opening 27, and the right exposed part 79 is positioned above and rearward of the right opening 27. Next, the supply roller 13 is moved downward along the second direction X so that the left exposed part 80 and right exposed part 79 pass through the corresponding exposing grooves 28 (between the open edges 34) and enter the exposing holes 29. Through this operation, the right and left exposed parts 79 and 80 move through the corresponding openings 27 as the supply roller 13 is inserted.

When the supply roller 13 reaches a prescribed position inside the arc-shaped wall 42 (FIG. 3), the left exposed part 80 is positioned within the receiving groove 51 of the left receiving part 50 (FIG. 4), and the small-diameter part 70 of the right exposed part 79 is positioned in the narrow groove 54 of the right receiving part 50 (FIG. 5). In other words, the small-diameter part 70 is disposed to corresponding to the narrow groove 54 with respect to the left-right direction. Consequently, the small-diameter part 70 becomes engaged with the narrow groove 54, thereby fixing the position of the supply roller 13 relative to the lower frame 31.

This completes the process of mounting the supply roller 13 in the lower frame 31. At this time, the left exposed part 80 of the supply roller shaft 18 is inserted through the left exposing hole 29 and protrudes leftward from the left side wall 35. When projected in the left-right direction, the supply roller shaft 18 is positioned within the supply-roller-shaft-exposing holes 29.

(2) Mounting the First and Second Side Sealing Members in the Lower Frame

Next, the first and second side sealing members 59 and 60 are mounted in the lower frame 31. To mount the first and second side sealing members 59 and 60 in the lower frame 31, first the first side sealing members 59 are inserted into the lower frame 31, as shown in FIG. 6.

To mount the first side sealing members 59 in the lower frame 31, the first side sealing members 59 are positioned on the left and right outer sides of the corresponding left and right exposed parts 80 and 79, with their through-holes 63 aligned with the respective left and right exposed parts 80 and 79. Next, the first side sealing members 59 are inserted inward into the developing chamber 39 in respective left and right directions until coming into contact with respective left and right outer surfaces of the corresponding receiving parts 50. At this time, the left and right exposed parts 80 and 79 are inserted through the through-holes 63 formed in the first side sealing members 59.

Next, the second side sealing members 60 are placed above the corresponding first side sealing members 59. This completes the process for assembling the first and second side sealing members 59 and 60 in the lower frame 31.

(4) Mounting the Developing Roller in the Lower Frame

Next, the developing roller 6 is assembled in the lower frame 31. To mount the developing roller 6 in the lower frame 31, the developing roller 6 is positioned above and rearward of the lower frame 31, as shown in FIG. 7, so that the left exposed part 82 is positioned above and rearward of the left exposing groove 28 and the right exposed part 81 is positioned above and rearward of the right exposing groove 28. Next, the developing roller 6 is moved downward in the second direction X while the left exposed part 82 and the right exposed part 81 pass through the corresponding open edges 34 until the rubber roller 17 contacts the sponge roller 19.

More specifically, the right exposed part 81 is inserted into the right exposing groove 28 from a position above and rearward thereof so that the contact members 100 on the right exposed part 81 fit on both left and right sides of the retaining parts 85. The left exposed part 82 is also inserted into the left exposing groove 28 from a position diagonally above and rearward thereof. Consequently, the retaining parts 85 are interposed between the pair of contact members 100, as shown in FIG. 8, with the inner left and right surfaces of the contact members 100 contacting the outer left and right surfaces of the retaining parts 85. This completes the operation for assembling the developing roller 6 to the lower frame 31.

At this time, the developing roller shaft 16 is positioned closer to the open edges 34 than the supply roller shaft 18. When projected in the left-right direction, the developing roller shaft 16 is positioned in the exposing grooves 28.

Further, one of the second side sealing members 60 is interposed between the left exposed part 80 of the supply roller shaft 18 and the left end of the rubber roller 17, and the other second side sealing member 60 is interposed between the right exposed part 79 and the right end of the rubber roller 17.

(5) Assembling the Bearing Members on the Lower Frame

Next, the bearing members 61 are mounted on the lower frame 31. That is, as shown in FIG. 7, the left bearing member 65 is mounted on the left side wall 35 from the left side, and the right bearing member 66 is mounted on the right side wall 35 from the right side.

When mounting the left bearing member 65 on the left side wall 35, the left bearing member 65 is moved toward the left side wall 35 from the left side so that the left exposed part 80 is inserted through the supporting hole 73 and the left end of the developing roller shaft 16 is inserted through the supporting hole 72.

When mounting the right bearing member 66 on the right side wall 35, the right bearing member 66 is moved toward the side wall 35 from the right side so that the right exposed part 79 is inserted through the supporting part 88 and the right exposed part 81 is inserted through the supporting hole 86 and the collar 87. By performing this operation, the right side portion of the right exposed part 81 is covered by the collar 87, as shown in FIGS. 2 and 7.

At this time, the upper edge of the left bearing member 65 opposes the upper flange part 67 on the left side wall 35 vertically, as shown in FIG. 7. Similarly, the upper edge of the right bearing member 66 opposes the upper flange part 67 of the right side wall 35 vertically.

Additionally, the lower portion on the rear edge of the right bearing member 66 opposes the rear portion of the lower flange part 68 in the front-rear direction, while the lower edge of the right bearing member 66 opposes the lower portion of the lower flange part 68 vertically (see FIG. 8).

The above operations complete the process of mounting the bearing member 61 on the lower frame 31. After completing these operations, the left exposed part 80 is rotatably supported in the supporting hole 73, and the right exposed part 79 is rotatably supported in the supporting part 88. Further, the left exposed part 82 is rotatably supported in the supporting hole 72, and the right exposed part 81 is rotatably supported in the supporting hole 86. Note that the right exposed part 81 protruding rightward from the supporting hole 86 is covered by the collar 87.

(6) Assembling the Upper Frame and Thickness-Regulating Blade on the Lower Frame Next, the upper frame 32 is assembled to the lower frame 31, as illustrated in FIGS. 2 and 4. To assemble the upper frame 32 on the lower frame 31, the upper frame 32 is placed on top of the lower frame 31 such that the contact part 62 of the upper frame 32 is aligned with the first and second contact parts 56 and 57 of the lower frame 31 (see FIG. 8). Subsequently, the contact part 62 is welded to the first and second contact parts 56 and 57.

Assembling the lower frame 31 and the upper frame 32 in this way forms the developer frame 30. At this time, the fixing parts 46 of the lower frame 31 protrude out from the rear-side top wall 53 (see FIG. 4). Note that when assembling the developer cartridge 23, the upper frame 32 is first assembled to the lower frame 31 to form the developer frame 30, after which the supply roller 13, the first side sealing members 59, the second side sealing members 60, the developing roller 6, and the bearing members 61 can be sequentially assembled as described above.

Next, the thickness-regulating blade 14 is fixed to the fixing parts 46. This completes assembly of the developer cartridge 23.

Thereafter, the toner-accommodating chamber 38 is filled with toner via the toner fill hole 98. Once the toner-accommodating chamber 38 is filled, a cap (not shown) is press-fitted into the toner fill hole 98 to seal the toner in the toner-accommodating chamber 38.

4. Operational Advantages (1) As shown in FIG. 4, the opening 27 is formed in each of the side walls 35 of the developer cartridge 23. The openings 27 extend in the direction X, as shown in FIG. 5, with the top sides serving as the open edges 34 and the bottom sides serving as the closed edges 33.

Therefore, when the supply roller 13 is assembled in the lower frame 31, as shown in FIG. 6, the supply roller 13 can be inserted into the lower frame 31 so that the left exposed part 80 and the right exposed part 79 pass through the exposing grooves 28 of the corresponding openings 27 toward the closed edges 33.

As a result, the operation for mounting the supply roller 13 in the lower frame 31 can be made more efficient. Hence, the invention offers a simple construction for increasing efficiency in the operation for mounting the supply roller 13 in the lower frame 31 and for improving production efficiency of the developer cartridge 23.

(2) The lower frame 31 has the bottom wall 36, as shown in FIG. 4. The receiving parts 50, in which the respective receiving grooves 51 are formed, are provided on the bottom wall 36. Accordingly, when mounting the supply roller 13 in the lower frame 31, the receiving grooves 51 can receive the supply roller shaft 18, as shown in FIG. 6.

As a result, the supply roller 13 can be placed smoothly into a prescribed position in the lower frame 31. Hence, it is possible to further improve efficiency in the operation for mounting the supply roller 13 in the lower frame 31.

Further, since the supply roller 13 can be positioned relative to the lower frame 31 with accuracy, it is possible to improve the accuracy in positioning the developing roller 6 and the supply roller 13 relative to each other through a simple construction.

(3) The left and right ends of the supply roller shaft 18 are defined as the left and right exposed parts 80 and 79, respectively. The small-diameter part 70 is formed in the right exposed part 79. Further, receiving parts 50 are disposed one inside each of the side walls 35, with respect to the left-right direction, so that a gap is formed between the receiving parts 50 and corresponding side walls 35. The narrow groove 54 is formed in the right receiving part 50, as shown in FIG. 5. With this construction, the small-diameter part 70 engages with the narrow groove 54, as shown in FIG. 6, when the supply roller 13 is mounted in the lower frame 31. This configuration positions the supply roller shaft 18 in the left-right direction relative to the lower frame 31, thereby smoothly placing the supply roller 13 in a prescribed position within the lower frame 31.

Hence, this construction can improve the efficiency of the operation for mounting the supply roller 13 in the lower frame 31. Further, by restricting left-right movement of the supply roller 13, this construction can prevent the supply roller 13 from falling out of the developer frame 30.

(4) As shown in FIG. 8, a pair of contact members 100 is provided on the right exposed part 81. The contact members 100 are disposed so as to fit on both left and right sides of the retaining parts 85 when the developing roller 6 is mounted in the lower frame 31. At this time, the left and right surfaces of the retaining parts 85 are in contact with the inside left and right surfaces of the contact members 100. Therefore, the developing roller shaft 16 can be positioned in the left-right direction relative to the lower frame 31. As a result, the developing roller 6 can be smoothly placed in a prescribed position within the lower frame 31.

Therefore, this construction can improve the efficiency in the operation for mounting the developing roller 6 in the lower frame 31, while improving the accuracy for positioning the rubber roller 17 and the sponge roller 19 relative to each other. Further, by restricting left-right movement of the developing roller shaft 16, this construction can prevent the developing roller 6 from falling out of the developer frame 30.

(5) The developer cartridge 23 is also provided with the left bearing member 65 and the right bearing member 66, as shown in FIG. 7. Both the left and right bearing members 65 and 66 are formed of an electrically conductive polyacetal resin material having excellent tribological properties. This configuration allows for smooth rotation of the developing roller 6 and the supply roller 13 and maintains the relative positions of the rubber roller 17 and the sponge roller 19 constant.

(6) The right bearing member 66 also includes the collar 87. As shown in FIGS. 2 and 7, the collar 87 covers the right end portion of the right exposed part 81 when the right bearing member 66 is assembled in the lower frame 31. Therefore, the right bearing member 66 can reliably support the right exposed part 81. This construction can improve the accuracy in positioning the rubber roller 17 and the sponge roller 19 relative to each other.

(7) The side walls 35 are also provided with the upper flange parts 67, as shown in FIG. 7. The upper flange parts 67 vertically oppose the upper edges of the corresponding bearing members 61 when the bearing members 61 are attached to the corresponding side walls 35. Therefore, attaching the bearing members 61 to the side walls 35 can enhance the strength of the side walls 35, thereby improving the strength of the lower frame 31.

Accordingly, through a simple construction, it is possible to improve efficiency in the operation for mounting the supply roller 13 in the lower frame 31, while also enhancing the strength of the lower frame 31.

5. Second Embodiment

Figure 9A:
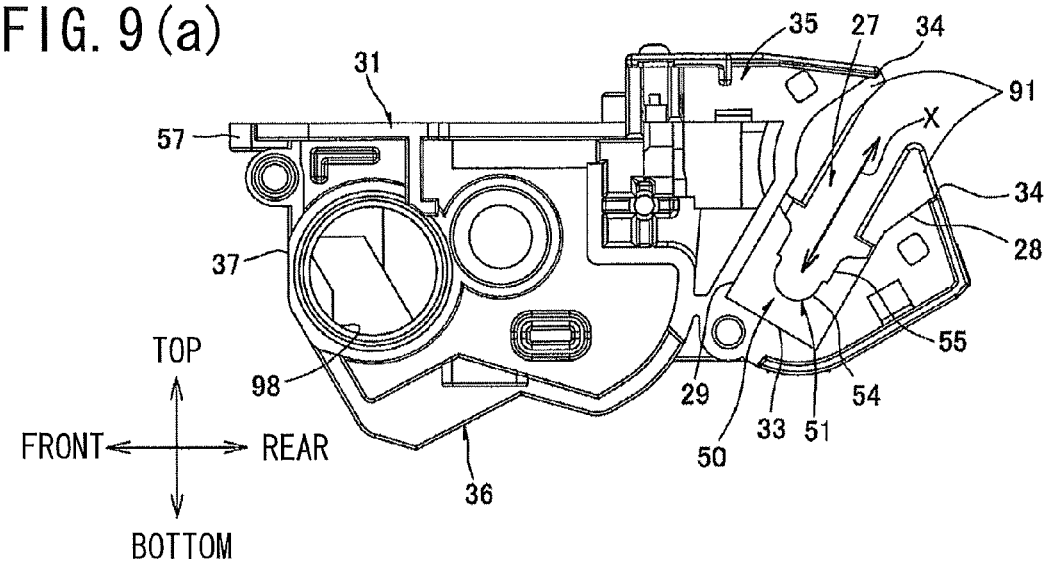
FIG. 9(*a*) is a right side view of a lower frame according to a second embodiment of the present invention.
Figure 9B:
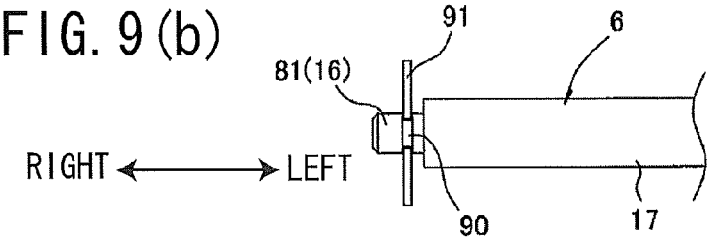
Figure 9C:
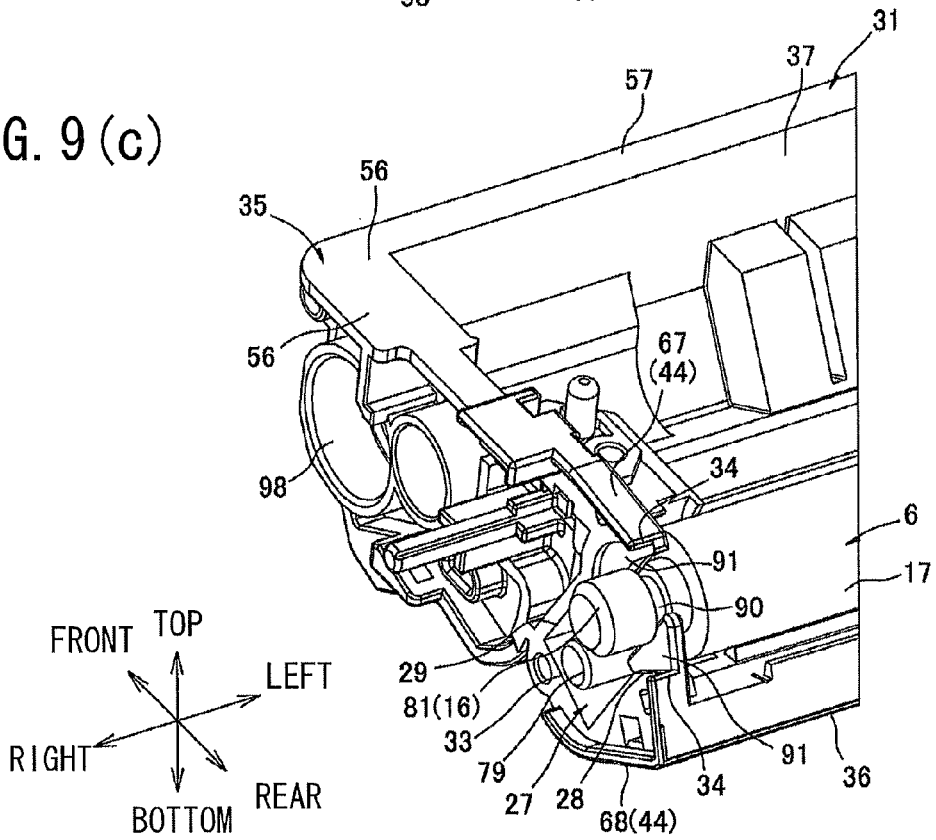

Next, a second embodiment of the present invention will be described. FIG. 9(*a*) is a right side view of the lower frame 31 in a developer cartridge according to the second embodiment of the present invention; FIG. 9(*b*) is a plan view of the developing roller 6 in the developer cartridge according to the second embodiment; and FIG. 9(*c*) is an enlarged view showing the right end of the lower frame 31 when the developing roller 6 shown in FIG. 9(*b*) is mounted in the lower frame 31 shown in FIG. 9(*a*). In FIGS. 9(*a*)-9(*c*), like parts and components to those described in FIGS. 1 through 8 are designated with the same reference numerals to avoid duplicating description.

As described in the first embodiment with reference to FIG. 8, the right exposed part 81 is provided with the pair of contact members 100. However, in the second embodiment shown in FIG. 9(*b*), a small-diameter part 90 is formed in the right exposed part 81. The small-diameter part 90 is formed by recessing the outer peripheral surface of the right exposed part 81 radially inward so that the diameter of the small-diameter part 90 is smaller than the diameter of the left exposed part 82.

As shown in FIG. 9(*c*), the developer frame includes the holding part 91 that is disposed adjacent the cutout of the side wall 35. The small-diameter part 90 is gripped by holding parts 91. As shown in FIG. 9(*a*), the holding parts 91 are formed on the lower rear edge and upper front edge of the right exposing groove 28, and specifically on the left side portions thereof. The holding parts 91 have a generally flat plate shape and protrude inward in front and rear directions, respectively. The inner edges of the holding parts 91 with respect to the front-rear direction extend linearly along the direction X. The gap formed between the holding parts 91 in a direction orthogonal to both the second direction X and the left-right direction is substantially equivalent to the diameter of the small-diameter part 90.

With this construction, the holding parts 91 engage the small-diameter part 90 when the developing roller 6 is mounted in the lower frame 31. Accordingly, the holding parts 91 hold the right exposed part 81, as shown in FIG. 9(*b*), thereby fixing the left-right position of the developing roller shaft 16 relative to the lower frame 31.

Hence, the structure of the second embodiment described above enables the developing roller 6 to be smoothly placed in a prescribed position within the lower frame 31, while reducing the number of required parts. The structure of the second embodiment also enables the developing roller 6 to be positioned relative to the lower frame 31 with accuracy.

Consequently, the above construction can improve efficiency in the operation for mounting the developing roller 6 in the lower frame 31, while also improving accuracy in positioning the rubber roller 17 and the sponge roller 19 relative to each other. Further, by restricting left and right movement of the developing roller 6, the above structure can prevent the developing roller 6 from falling out of the developer frame 30.

6. Third, Fourth, and Fifth Embodiments

Figure 10A:
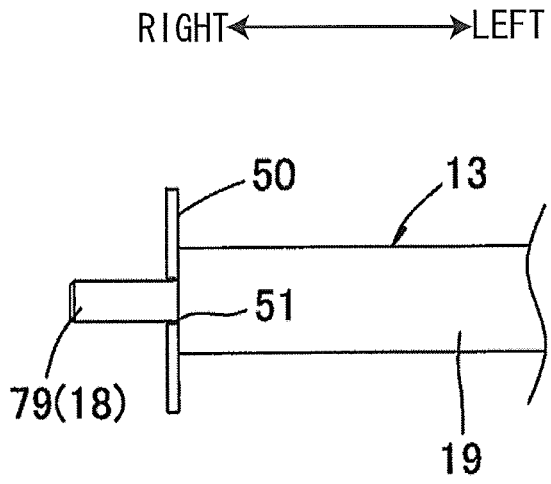
FIG. 10(*a*) is a plan view showing a supply roller according to a third embodiment.
Figure 10B:
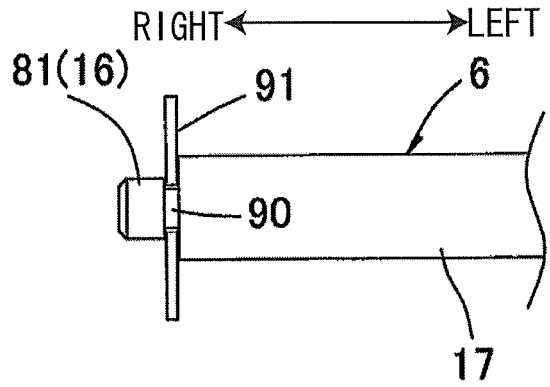
Figure 10C:
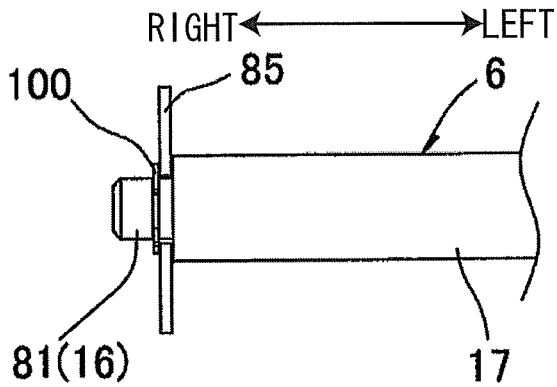

Next, third, fourth, and fifth embodiments of the invention will be described. FIG. 10(*a*) is a plan view showing the supply roller 13 in a developer cartridge according to a third embodiment; and FIGS. 10(*b*) and 10(*c*) are plan views showing the developing roller 6 in a developer cartridge according to fourth and fifth embodiments, respectively. In FIGS. 10(*a*)-10(*c*), like parts and components to those described in FIGS. 1 through 9 are designated with the same reference numerals to avoid duplicating description.

In the first embodiment described above, the small-diameter part 70 is formed in the right exposed part 79, as shown in FIG. 6, and the narrow groove 54 for engaging with the small-diameter part 70 is formed in the right receiving groove 51, as shown in FIG. 5. However, in the third embodiment shown in FIG. 10(*a*), the small-diameter part 70 is not formed on the right exposed part 79, nor is the narrow groove 54 formed in the right receiving groove 51. Instead, the right end of the sponge roller 19 contacts the left surface of the receiving part 50 when the supply roller 13 is mounted in the lower frame 31. In this way, the supply roller 13 can be positioned in the left-right direction relative to the lower frame 31.

The structure of the third embodiment described above can obtain the same operational advantages described in the first embodiment.

In the fourth embodiment shown in FIG. 10(*b*), the right end of the rubber roller 17 contacts the left surface of the holding part 91 when the developing roller 6 is mounted in the lower frame 31. Hence, the developing roller 6 can be reliably positioned in the left-right direction relative to the lower frame 31. As a result, the fourth embodiment can obtain the same operational advantages described in the first embodiment.

In the fifth embodiment shown in FIG. 10(*c*), only a single contact member 100 is provided on the right exposed part 81. When the developing roller 6 is mounted in the lower frame 31, the retaining part 85 is interposed between the contact member 100 and the right end of the rubber roller 17. In other words, the left surface of the contact member 100 contacts the right surface of the retaining part 85, while the right endface of the rubber roller 17 contacts the left surface of the retaining part 85. Hence, the developing roller 6 can be reliably positioned in the left-right direction relative to the lower frame 31. As a result, the fifth embodiment can also obtain the same operational advantages described in the first embodiment.

What is claimed is:

1. A developing device comprising:

a developing roller having:

a first rotational shaft extending in a first direction; and a first roller body covering the first rotational shaft and configured to carry developer;

a supply roller having:

a second rotational shaft extending in the first direction; and a second roller body covering the second rotational shaft and configured to supply the developer to the developing roller;

a housing accommodating the developing roller, the supply roller, and the developer, the housing comprising a first wall and a second wall opposed to each other in the first direction, the first wall being formed with a first cutout and including a flange part protruding in the first direction, the second wall being formed with a second cutout; and a first bearing member including a main portion and a supporting portion, the main portion including an endface and having a plate shape having a thickness in the first direction, the supporting portion being formed with a through hole, the supporting portion supporting an end of the first rotational shaft via the through hole, the first bearing member being separately provided from the housing, wherein the first rotational shaft and the second rotational shaft are positioned in both the first cutout and the second cutout when projected in the first direction, and wherein the flange part contacts at least a portion of the endface extending in the first direction.

2. The developing device according to claim 1, wherein the first rotational shaft includes a first end portion and a second end portion in the first direction, wherein the second rotational shaft includes a third end portion and a fourth end portion in the first direction, wherein the first end portion and the third end portion are disposed in the first cutout, and wherein the second end portion and the fourth end portion are disposed in the second cutout.

3. The developing device according to claim 2, wherein the first cutout and the second cutout extend in a second direction orthogonal to the first direction, the first cutout including a first cutout edge in the second direction, the second cutout including a second cutout edge in the second direction, wherein the housing further comprises a receiving portion including a receiving groove that receives the second rotational shaft, and wherein the receiving portion overlaps both the first cutout edge and the second cutout edge when projected in the first direction.

4. The developing device according to claim 3, wherein the second roller body covers the second rotational shaft while leaving both the third end portion and the fourth end portion exposed, wherein the receiving portion includes a first receiving portion and a second receiving portion each having a receiving groove, wherein the receiving groove of the first receiving portion includes a narrow groove whose width is narrower than a width of the receiving groove of the second receiving portion, and wherein the third end portion has a small diameter part whose diameter is smaller than a diameter of the fourth end portion, the small diameter part being disposed to correspond to the narrow groove with respect to the first direction and to engage with the narrow groove.

5. The developing device according to claim 3, wherein the first roller body covers the first rotational shaft while leaving both the first end portion and the second end portion exposed, wherein the first end portion has a small diameter part whose diameter is smaller than a diameter of the second end portion, and wherein the housing further includes a holding part disposed adjacent the first cutout, the holding part engaged with the small diameter part to hold the third end portion.

6. The developing device according to claim 3, wherein the developing roller further has a pair of side surfaces connected to each end of the first roller body, one of the pair of side surfaces contacting a periphery of one of the first and second cutouts.

7. The developing device according to claim 3, wherein the developing roller further has a contact member disposed at the first end portion, the contact member contacting a periphery of the first cutout.

8. The developing device according to claim 7, wherein the contact member includes a pair of contacting members pinching the periphery of the first cutout.

9. The developing device according to claim 3, wherein the developing device further comprises a second bearing member, wherein the first bearing member rotatably supports the first end portion and the third end portion, and wherein the second bearing member rotatably supports the second end portion and the fourth end portion.

10. The developing device according to claim 9, wherein the first bearing member includes a collar covering the first end portion.

11. The developing device according to claim 9, wherein the second wall comprises a flange part opposing at least part of the second bearing member.

12. A method for assembling a developing device, comprising:

preparing a developing roller having: a first rotational shaft extending in a first direction; and a first roller body covering the first rotational shaft and configured to carry developer;

preparing a supply roller having: a second rotational shaft extending in the first direction; and a second roller body covering the second rotational shaft and configured to supply the developer to the developing roller;

preparing a housing comprising: a first wall, and a second wall opposed to each other in the first direction, the first wall being formed with a first cutout, the second wall being formed with a second cutout, the housing being formed with an opening, the first cutout and the second cutout, the first wall including a flange part protruding in the first direction;

preparing a bearing member including a main portion and a supporting portion, the main portion including an endface and having a plate shape having a thickness in the first direction, the supporting portion being formed with a through hole, the bearing member being separately provided from the housing;

assembling, to the housing, the supply roller with one end of the second rotational shaft being moved in the first cutout and another end of the second rotational shaft being moved in the second cutout;

assembling, to the housing, the developing roller with one end of the first rotational shaft being moved in the first cutout and another end of the second rotational shaft being moved in the second cutout until the developing roller contacts the supply roller; and assembling, to the housing, the bearing member with the supporting portion supporting the one end of the first rotational shaft via the through hole such that the flange part contacts at a least a portion of the endface extending in the first direction.

13. The developing device according to claim 1, wherein the flange includes a first flange part and a second flange part opposite to the first flange part via the supporting portion in a third direction orthogonal to the first direction.

* * * * *